US006848854B2

(12) United States Patent
Massé

(10) Patent No.: US 6,848,854 B2
(45) Date of Patent: Feb. 1, 2005

(54) CONNECTOR-MOUNTING ASSEMBLY

(75) Inventor: Dominique Massé, Epinay sur Orge (FR)

(73) Assignee: Infra+, Les Roses (FR)

( * ) Notice: Subject to any disclaimer, the term of this patent is extended or adjusted under 35 U.S.C. 154(b) by 0 days.

(21) Appl. No.: 10/119,831

(22) Filed: Apr. 11, 2002

(65) Prior Publication Data

US 2002/0171339 A1 Nov. 21, 2002

(30) Foreign Application Priority Data

Apr. 12, 2001 (FR) ..... 01 05086

(51) Int. Cl.[7] ..... F16B 21/00

(52) U.S. Cl. ..... 403/329; 403/321; 403/326; 312/223.6; 361/826

(58) Field of Search ..... 211/26; 361/826; 248/49, 53, 68.1, 73, 74.1; 312/223.6; 108/50.02; 403/321, 322.1, 322.3, 322.4, 326, 329, 299, 345, 373, 374.1, 374.2, 374.5

(56) References Cited

U.S. PATENT DOCUMENTS 6,003,804 A * 12/1999 Vara ..... 211/26
6,170,784 B1 * 1/2001 MacDonald et al. ..... 248/68.1
6,403,885 B1 * 6/2002 Baker, III et al. ..... 248/49

FOREIGN PATENT DOCUMENTS

| | | |
|---|---|---|
| EP | 0 762 586 | 3/1997 |
| FR | 2 688 354 | 9/1993 |

* cited by examiner

*Primary Examiner*—Daniel P. Stodola
*Assistant Examiner*—Michael P. Ferguson
(74) *Attorney, Agent, or Firm*—Sughrue Mion, PLLC

(57) ABSTRACT

A connector-mounting assembly comprises:

a longitudinal mounting shelf provided with fastening means for fastening to at least one rail, and with catch means placed along the length of the shelf; and at least one connector support having a front face, a rear face, a bottom end, and a top end, said support being provided with fixing means co-operating with the catch means of the shelf to fix the support to the shelf, and with reception means adapted to receive a suitable connector that is accessible from the front face, wherein the catch means extend in repeating manner substantially along a single line, and the fixing means of the support are situated at one end of the support so that the support projects vertically from the shelf when the shelf is fastened to a vertical support rail.

31 Claims, 6 Drawing Sheets

CONNECTOR-MOUNTING ASSEMBLY

The present invention relates to a connector-mounting assembly comprising both a longitudinal mounting shelf provided with fastening means for fastening it to at least one rail, and with catch means disposed along the length of the shelf, and at least one connector support having a front face, a rear face, a bottom end, and a top end, said support being provided with fixing means that co-operate with the catch means of the shelf to fix the support on the shelf, and reception means adapted to receive a suitable connector that is accessible from the front face.

BACKGROUND OF THE INVENTION

That kind of mounting assembly is in very widespread use when making distribution frames and subframes of the kind received in a cabinet. In general, two vertical support rails are provided having a plurality of mounting shelves mounted horizontally thereon. The mounting shelves are commonly referred to as strips, and they are of a practically standard length of 19 inches ("), hence the term 19" strips.

In a very conventional embodiment, the mounting shelf or strip includes a vertical front plate that has windows cut out therein to receive electrical or optical connectors (generally for low voltage applications) either directly or indirectly.

The present invention relates more particularly to a mounting assembly that has connector supports fixed to the mounting shelf or strip. Thus, each connector support is fixed to the front plate at a reception window. The connector support can be fixed directly to the edges of a window, or in a variant the mounting shelf or strip can have special fixing means situated on the rear face of the front plate that is provided with the windows. Connector supports can be fixed to respective windows either from the front face of the front plate or from its rear face. Nevertheless, connector supports are generally fitted to the front face of the front plate and as a result they project horizontally from said front plate.

Such connector supports include specific receiver means adapted to receive some particular type of electrical or optical connector. Connectors are put into place in such connector supports from the rear face of the connector support so as to present the socket of the connector in the corresponding window formed by the mounting shelf or strip.

For the purposes of mounting and cabling electrical or optical connectors in such a mounting assembly, it is preferable for the mounting shelf or strip to be still disconnected from the vertical support rails. The connector supports can then be mounted on the mounting shelf or strip and the connection cables can be connected to the various connectors. Once the connectors have been cabled in this way they can be fitted to their respective connector supports, and the mounting shelf or strip as fitted in this way is finally fastened to the vertical support means.

It often happens that certain connectors need to be modified, added, or replaced for a variety of reasons associated, for example, with a new application or with equipment modernization. Under such circumstances, it is necessary to remove the mounting shelf or strip from its support rails in order to gain access to the connectors fitted into their respective connector supports from behind. Given that a standard 19" strip has 24 connector support locations and can therefore support 24 single connector supports, it will readily be understood that removing a mounting shelf or strip from its support rails is relatively laborious, since traction needs to be applied to 24 connection cables, each generally comprising eight individual conductor wires.

OBJECTS AND SUMMARY OF THE INVENTION

Consequently, an object of the present invention is to remedy the above-mentioned drawbacks of the prior art by defining a mounting assembly comprising both a mounting shelf and connector supports in which the electrical or optical connectors can be mounted in simplified manner, without it being necessary to withdraw the mounting shelf from its vertical support rails.

The present invention achieves this object by providing for the catch means to extend in repeated manner substantially along a single line, and the fixing means of the support to be situated at one end of the support so that the support projects vertically from the shelf when the shelf is fastened horizontally to at least one vertical support rail. Whereas in the prior art the front plate provided with reception windows constitutes a partitioning wall that prevents access to the connectors except through the windows, in the present invention there is no vertical front plate provided with reception windows, but on the contrary plane linear catch means from which the connector supports project either upwards or downwards, but in any event vertically. Consequently, the connector supports are held at one end only, and preferably via their bottom ends so that they project vertically upwards from the shelf. It should be observed that the mounting shelf of the present invention no longer constitutes a strip in the meaning of the prior art since it no longer forms a vertical longitudinal front plate that has given rise quite understandably to the term "strip" for the prior art mounting shelf. In the absence of such a front plate, it is no longer the mounting shelf which constitutes the front face of the mounting assembly, but instead the front faces of connector supports fixed to the mounting shelf. In this way, the mounting shelf is no longer even visible once all the connector supports have been mounted.

Advantageously, the mounting shelf has a front side and a rear side, the front face of the connector support being situated at the front side of the shelf and the rear face of the support facing towards the rear side of the shelf, the fixing means of the connector co-operating with the catch means of the shelf in such a manner that the connector support can be withdrawn from the shelf by taking hold of the support via its front face from the front side of the shelf, and moving it away from the rear side of the shelf. Each connector support can thus be removed individually from the shelf together with its respective connector fitted thereto and without being impeded by the shelf, as used to be the case in the prior art because of the presence of the front plate. With such a mounting assembly, it is possible to begin by mounting the mounting shelves on their vertical support rails, then to cable the connectors, to fit them into their respective connector supports, and finally to put the connector supports into place with their connectors already fitted to them on the mounting shelf that has already been fastened to the support rails. By releasing the front face of the mounting shelf, i.e. by omitting the front plate, and by replacing it with plane linear catch means situated either at the bottom or at the top, a large amount of space is released which can advantageously be used for the connector supports themselves.

As mentioned above, it is preferable for the connector supports to extend vertically upwards from the mounting shelf. Under such circumstances, the reception means of the support are situated above its fixing means. Advantageously, the support has mounting means for holding an accessory, said mounting means being situated at the end of the-support opposite from its end where the fixing means are situated and being spaced apart from the fixing means by the reception means. Under such circumstances, the accessory mounting means are situated at the free top end of the support that points away from the catch means of the shelf. The connector supports are thus well organized in levels from the bottom upwards, beginning with the fixing means, continuing with the reception means above them, and then continuing with the means for mounting connector accessories. Whereas previously the mounting shelf literally surrounded the connector support, since it was received in a reception window, the mounting shelf of the invention now occupies only the bottom (or top) portion of the connector supports which are thus free to extend freely upwards (or downwards).

According to characteristic of the invention, the fixing means engage the catch means during displacement in horizontal translation while the shelf is mounted on the vertical rails. The connector supports can thus be fitted to or withdrawn from the mounting shelf from the front side of the shelf and they do not require any top or bottom space or clearance, given that the displacement takes place horizontally, not vertically. This is an important effect since, in a distribution frame or subframe, a plurality of mounting shelves are placed one above another without any intervening space. Consequently, it is more advantageous to be able to put the supports into place using horizontal displacement rather than vertical displacement, since vertical displacement would require the mounting shelf situated immediately above or below to be removed, thus giving rise to even more work. Thus, with the mounting assembly of the invention, the visible panel of the distribution frame or subframe is built up entirely by the front faces of the connector supports and not by the front plates of prior art strips.

According to another characteristic, the fixing means include snap-fastening means which co-operate with the catch means of the shelf at the end of the displacement in translation. Advantageously, the fixing means form translation-guiding elements and snap-fastening shapes, and the catch means form guide appendices on which the guide elements of the support are adapted to be engaged by sliding, and also having retaining shapes that co-operate with the snap-fastening shapes of the support.

According to another characteristic which is particularly advantageous, the snap-fastening means include release means that can be actuated from the front face of the support. Advantageously, the release means contain a fixing nut for receiving a connector accessory. The release means are preferably situated in a fixing base that integrates the fixing means.

In another aspect of the invention, the shelf has cable-holding means situated behind the catch means, the holding means comprising cable guides for slidably receiving the cables. Advantageously, the holding means co-operate with locking members suitable for locking the cables in their respective guides. The cables can thus be previously engaged in the holding means while the mounting shelf is already fixed to the vertical support rails. Once the connectors have been cabled and fitted to their respective connector supports, the supports can be mounted on the mounting shelf by causing the cables to slide through the holding means. Once the support is in place on the shelf, it then suffices to lock the cables in their respective guides.

BRIEF DESCRIPTION OF THE DRAWINGS

The invention is described below in greater detail with reference to the accompanying drawings relating to an embodiment of the invention given as a non-limiting example. In the figures.

MORE DETAILED DESCRIPTION

The mounting assembly of the invention for electrical and/or optical connectors essentially comprises two component parts, namely a mounting shelf 1 and one or more connector supports 2, 2'. Electrical or optical connectors 3 and their accessories 5 do not form part of the mounting assembly, and merely constitute accessories therefore. That is why it can be said that the mounting assembly comprises only two component elements.

Figure 1:
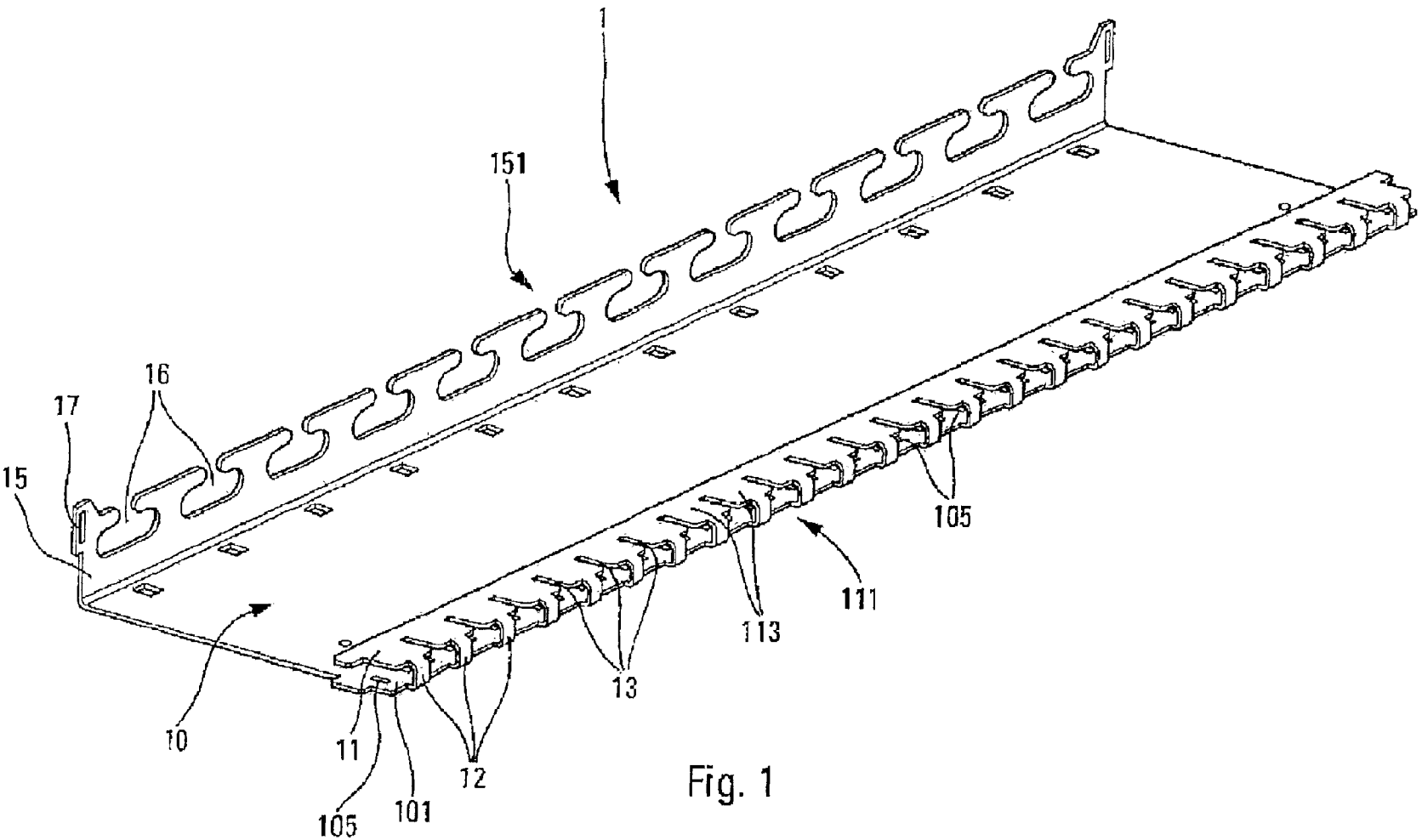
FIG. 1 is a perspective view of a mounting shelf of the invention.

With reference initially to FIG. 1, there can be seen a mounting shelf 1 in accordance with the invention. This shelf 1 presents a generally plane overall configuration in the longitudinal direction since it is constituted by a longitudinal base plate 10 that is designed to extend in a horizontal plane once the shelf has been mounted on vertical support rails. The base plate 10 has two free longitudinal ends and two longitudinally-extending edges, forming a vertical flange 15 on its rear side 151 and a flap 11 on its front side 111. The flange 15 on the rear side 151 forms a plurality of cable-receiving guides 16, there being twelve of them in this example, adapted to receive twenty-four connection cables. At its ends, the flange 15 forms fastening elements 17 adapted to co-operate with side brackets enabling the shelf to be fixed on vertical support rails. The presence of the flange 15 serves to increase the ability of the shelf to withstand twisting. The same applies to the flap 11 situated on the front side 111. The flap 11 extends substantially parallel to the base plate 10 over a front margin 101 thereof. An intermediate space 110 is thus provided between the flap 11 and the front margin 101. The flap 11 is connected to the front margin 101 by bridges 12 which embody the front longitudinally-extending edge of the shelf 1. The shelf shown in FIG. 1 has twenty-four bridges 12. The flap 11 is also provided with slots 13 extending parallel to one another from the front side 111 towards the rear side 151. The slots 13 are open towards the front side 111 and are situated between the bridges 12. There are twenty-three such slots 13 in this case. The slots 13 thus define tongues 113 to which the bridges 12 are respectively connected. The slots 13 could even extend over the entire width of the flap 11 so that each tongue 113 would then be separated individually and no longer be connected to the others as shown in FIG. 1. Nevertheless, connecting all of the tongues together increases the strength of the tongues and as a result also increases the overall strength of the shelf. The base plate 10 is also provided in the vicinity of its front margin 101 with holes 105 forming openings through the front margin 101. The function of these holes 105 is described below.

The shape of the shelf 1 in the vicinity of its front side 111, i.e. in the vicinity of its flap 11 and its front margin 101 that are interconnected by the bridges 12, constitutes catch means for co-operating with the connector supports for the purpose of fixing said supports to the mounting shelf. The arrangement of the tongues 113 and the bridges 12 forms a plurality of catch sites extending in repeating manner substantially along a common line defined by the front edge of the shelf 10 on its front side 111. In the embodiment of FIG. 1, the catch means form twenty-four catch sites placed side by side in a single line. All of the tongues 113 are situated in a common horizontal plane, whereas in the prior art the fixing front face extends in a vertical plane. Each catch site comprises one tongue and two holes.

Figure 3:
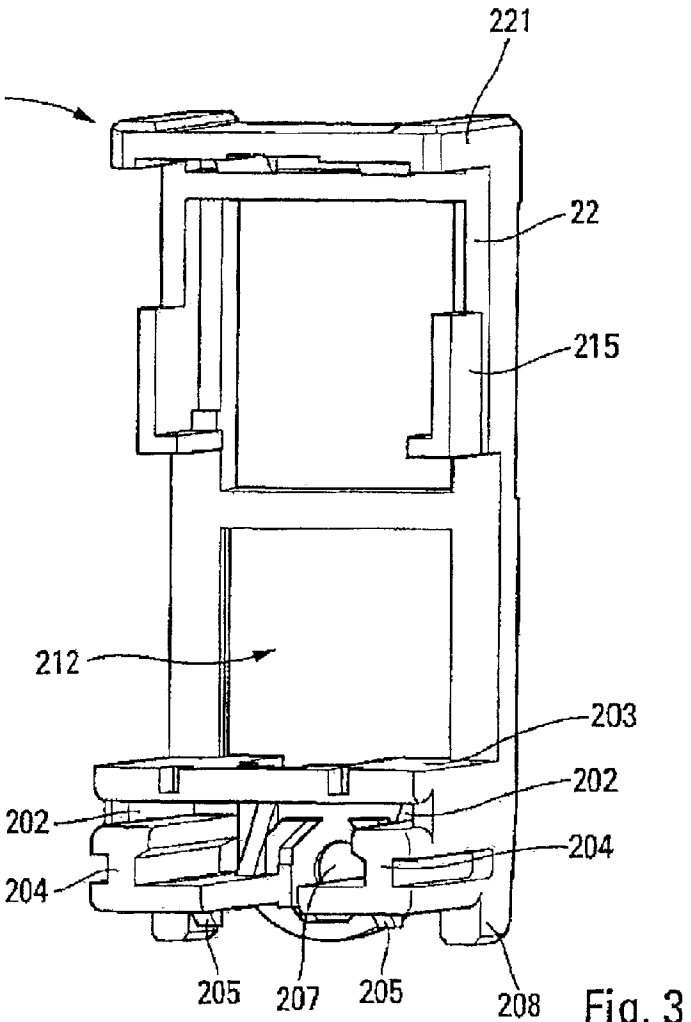
FIGS. 2 and 3 are perspective views from different angles showing a connector support of the invention.
Figure 2:
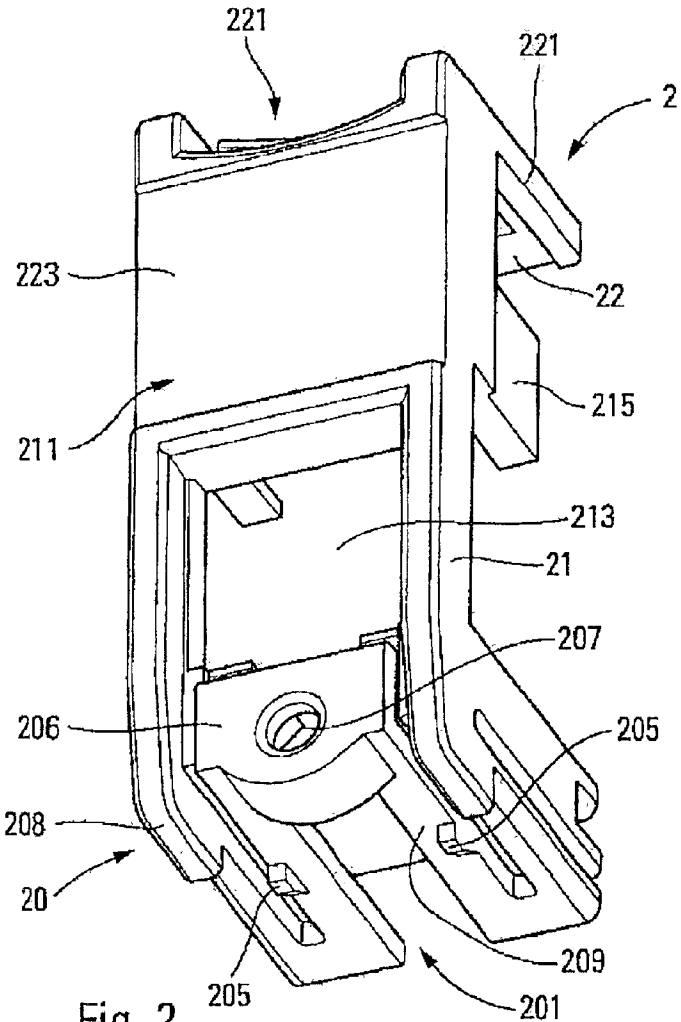

The mounting assembly also comprises at least one, and preferably more, connector supports given numerical reference 2 or 2'. The structure of these supports is described with reference to FIGS. 2 and 3. In FIGS. 2 and 3 there can be seen one particular, but standard type of connector support; other types of connector support also exist, such as the support referenced 2' in FIG. 5. Nevertheless, the description relates specifically to the connector 2 of FIGS. 2 and 3: the connector support 2' of FIG. 5 differs only in its width and the type of connector that it is designed to receive.

The connector support 2 comprises a base 20 situated at its bottom end 201 from which the remainder of the support extends. The support defines a front face 211, a rear face 212, a bottom end 201, and a top end 221.

The base 20 defines fixing means for co-operating with the catch means formed by the assembly shelf 1. More precisely, the base 20 forms a fixing housing 202 that is open towards the rear face and closed towards the front face, and into which a tongue 113 of the shelf 10 can be inserted by horizontal sliding motion in translation. In reality, it is the connector support which is fitted onto the shelf 1 by pushing the housing of the base 20 onto a tongue 113. It will thus easily be understood that the connector supports are put into place on the mounting shelf 1 from the front side 111 of the shelf by pushing the support against the front side 111 of the shelf towards its rear side 151. The movement is constituted by translation in a horizontal plane, i.e. in the same plane as the base plate 10 of the shelf 1. There is therefore no need to provide clearance space above or below the connector support in order to enable it to be put into place or removed from the shelf 1. The housing in the base 20 which serves as an element for guiding the support on the tongue of the shelf naturally extends in a horizontal plane, i.e. in the same plane as the tongues 113 so as to enable them to be inserted in the housing. A simple force or friction fit of the tongue 113 in the fixing housing 202 suffices to fix the support 2 on the shelf 1. Nevertheless, in the invention, snap-fastening studs 205 are also provided on the base 20 for being retained in the holes 105 formed in the front margin 101 of the base plate 10. Thus, at the end of the base 20 being engaged by guided sliding in translation on the corresponding tongue 113, the snap-fastening studs 205 spring resiliently into the holes 105, thereby preventing the support from being removed from the shelf by sliding. In order to enable the support to be released, i.e. in order to withdraw the studs 205 from the holes 105, release means 206 are provided that are accessible from the front face 211 of the connector support. This makes it possible to withdraw the support from the shelf from its front face 211 without needing access to its rear face 212.

Figure 4:
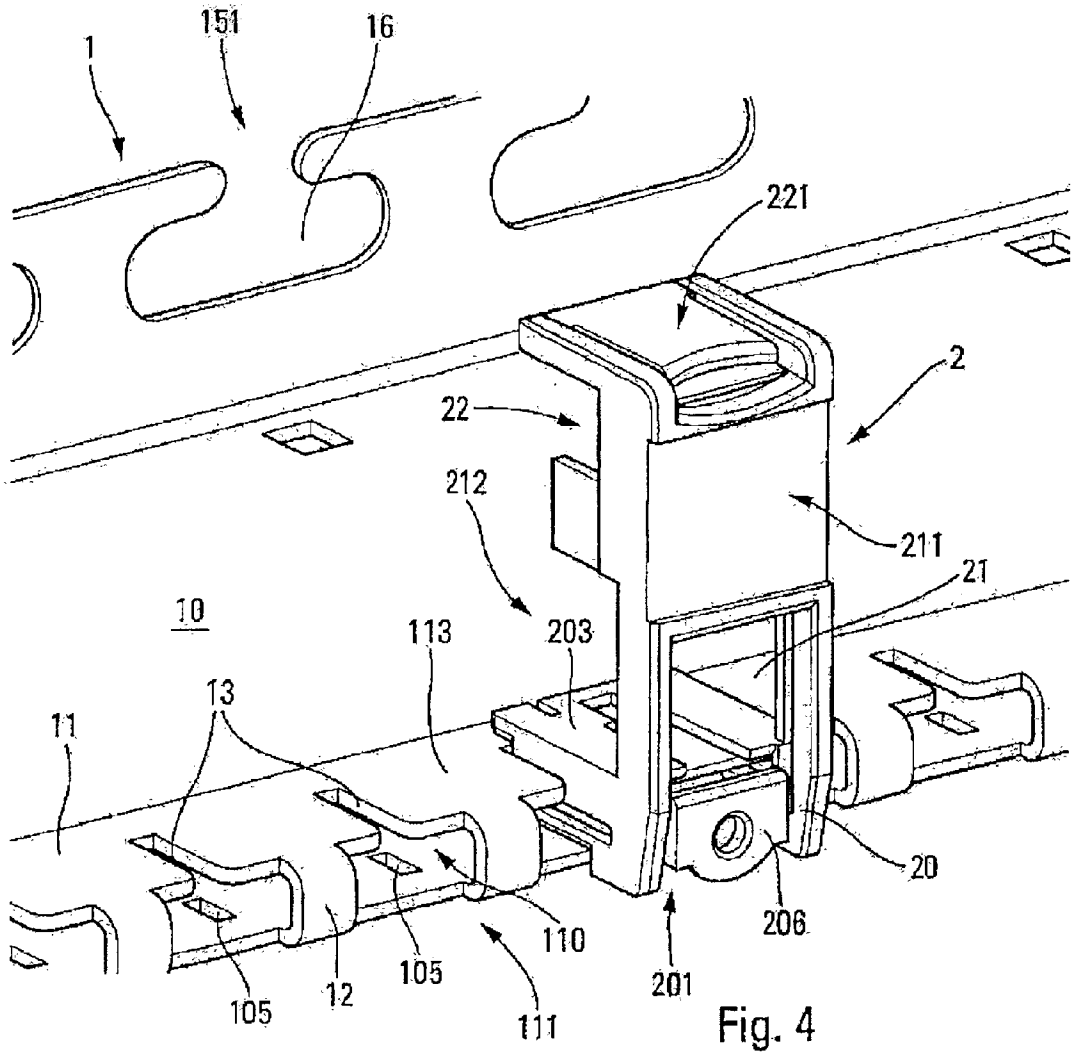
FIG. 4 is a perspective view showing the connector support of FIGS. 2 and 3 mounted on the assembly shelf of FIG. 1.

Structurally, the base 20 forms a top slab 203 which overlies the tongue 113 of the shelf 1 and which serves as a guidance appendix for the support, as can be seen in FIG. 4. The bottom surface of the slab 203 forms the top portion of the fixing housing 202. The housing 202 is thus formed immediately beneath the slab 203. Beneath the housing 202, the base 20 forms two side prongs 204 which are received in the intermediate space 110 formed between the flap 11 and the front margin 101 of the shelf 1. The engagement of the side prongs 204 in this space 110 with very little clearance serves to further improve the stability with which the connector support 2 is fixed on the shelf 1. The side prongs 204 point towards the rear from the front face 211 where they are connected to an actuator fork 209 on which the snap-fastening studs 205 are formed. This actuator fork 209 extends between the side prongs 204 with the web of the fork forming a release actuator member 206 that is accessible from the front face 211 of the connector support. The connection between the fork 209 and the side prongs 204 is elastic so moving the fork upwards enables the snap-fastening studs 205 to be extracted from the holes 105. Similarly, the elasticity of the fork enables the studs 205 to be engaged in the holes 105. Thus, while the support is being put into place on the shelf, the fork 209 is deformed elastically upwards so as to allow the snap-fastening studs 205 to be move over the front margin 101 until they reach the holes 105. Advantageously, the web of the fork which forms the actuator member proper is provided with a housing 107 for receiving a nut that is used to fix a connector accessory, for example a duplicator. The base 20 also forms stiffeners 208 which can serve as abutments against the front edge of the shelf on either side of a bridge 12. These stiffeners 208 extend below the base plate 10 of the shelf 1.

Above the base 20, the support 2 forms reception means 21 for receiving an optical or an electrical connector 3 of a type that is appropriate for the connector support. These reception means includes a window 213 through which the socket 31 of the connector 3 is accessible from the front face 211 of the connector support. The reception means is also defined by the slab 203 which serves as a support surface for the connector 3. In addition, the reception means 21 can have other prongs or catch elements or snap-fastening elements 215 enabling the connector to be held on the slab 203 so that its socket 31 is inserted in the window 213. It can be said that the reception means 21 is situated above the base 20 serving to fix the support on the shelf. The fixing means thus occupy the bottom portion of the support while the reception means 21 is situated above these fixing means.

Above the reception means 21, the support 2 also forms mounting means 22 for mounting a connector accessory, such as a coiling cassette for housing optical fiber, as is frequently associated with an optical connector. These mounting means define a mounting housing 22 formed by prongs or mounting elements 215 and a top slab 221 forming the top end of the connector. On its front face 211, the support can form a panel 223 which can advantageously serve to receive an identity tag enabling the connectors and their functions to be identified. The mounting means 22 are situated at the top level of the connector support 2. Consequently, it can be said that the base 20 with its means for fixing to the shelf are situated at the bottom level of the support, the reception means 21 at an intermediate position, and the mounting means 22 at the top level. This provides a connector support that is organized vertically, and not horizontally as is the case in the prior art.

FIG. 4 shows a connector support as described above mounted on a mounting shelf as described previously. It can be seen that the connector support projects upwards from the shelf 1: only its base is fixed to the shelf, with the slab 203 being situated immediately above the tongue 113 and the release member 206 being accessible from the front face. Going up from the slab 203, the support 2 is completely independent of the shelf 1 and therefore extends freely upwards to define the reception means 21 and the mounting means 22.

Figure 5:
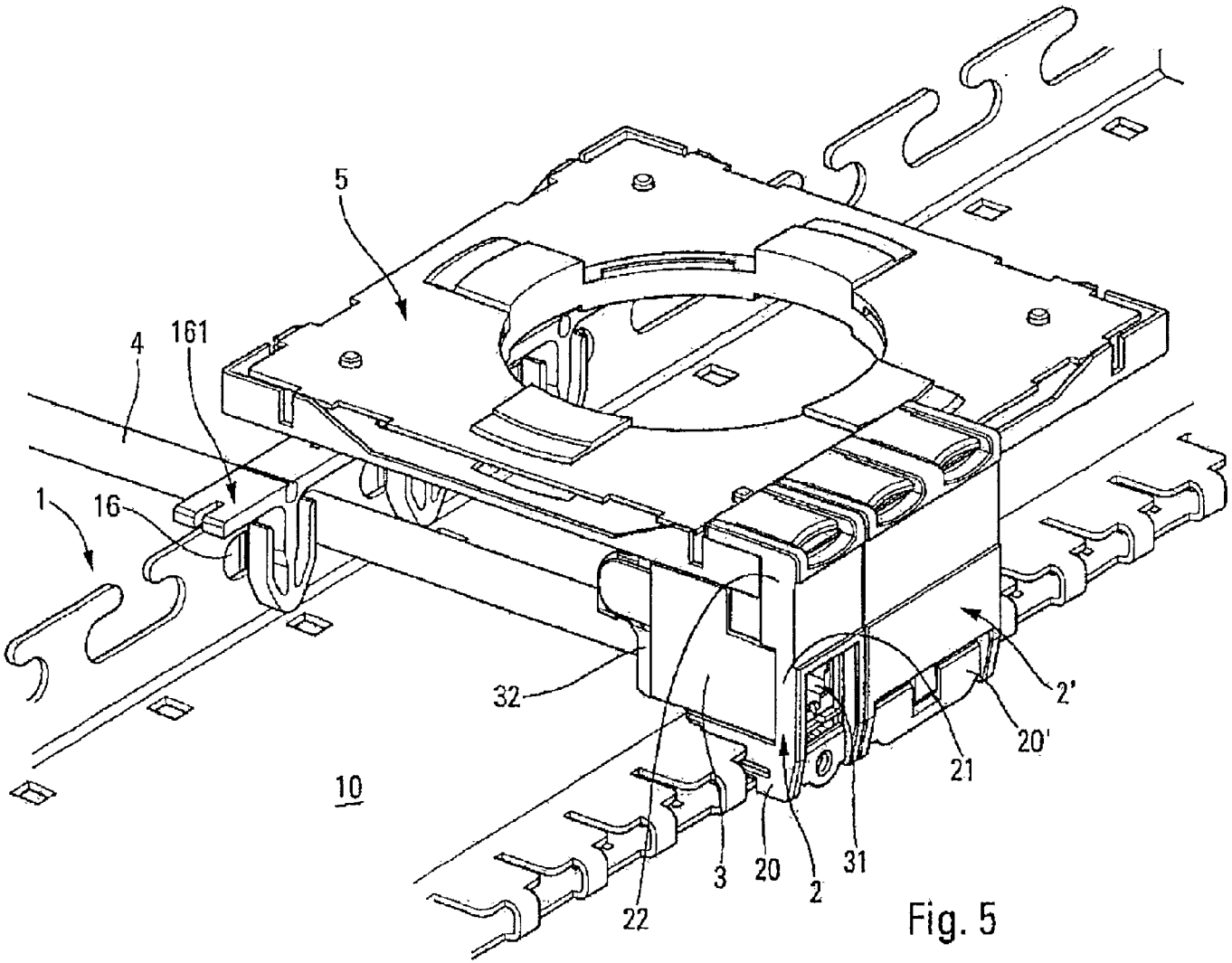
FIG. 5 is a perspective view of a mounting assembly of the invention fitted with connectors and with a connector accessory.

In FIG. 5, there can be seen beside the conventional connector support 2 of FIGS. 2 and 3 a connector support 2' of a different type that is mounted on two tongues 113. Consequently, the support 2' presents a pitch that is equal to twice that of the connector support 2. The pitch of the mounting assembly is defined by the spacing between the slots 13 which corresponds to approximately the width of the tongues 113. The connector support 2 is provided with a connector 3 engaged in the reception means 21 so as to present a socket 31 level with the window 213. On its rear face 32, the connector 3 is connected to a connection cable 4 which passes through a guide 16 formed in the flange 15 of the shelf 10. In addition, it can be seen that the cable 4 is held in the guide 16 by a clip member 161 that holds the cable 4 in position in the guide 16. By way of example, this clip member 161 can be made of a flexible material which exerts pressure and friction force on the cable 4 serving to hold it in the guide 16. Above the connector 3, an optical fiber coiling cassette 5 is placed in the mounting means 22. This coiling cassette is an accessory that is commonly used in association with an optical connector which can be received in the connector support 2', for example. It can be seen that the coiling cassette 5 is inserted in the mounting means 22 and also bears against the flange 15, thus making it possible to obtain very good stability for the accessory 5.

Figure 6:
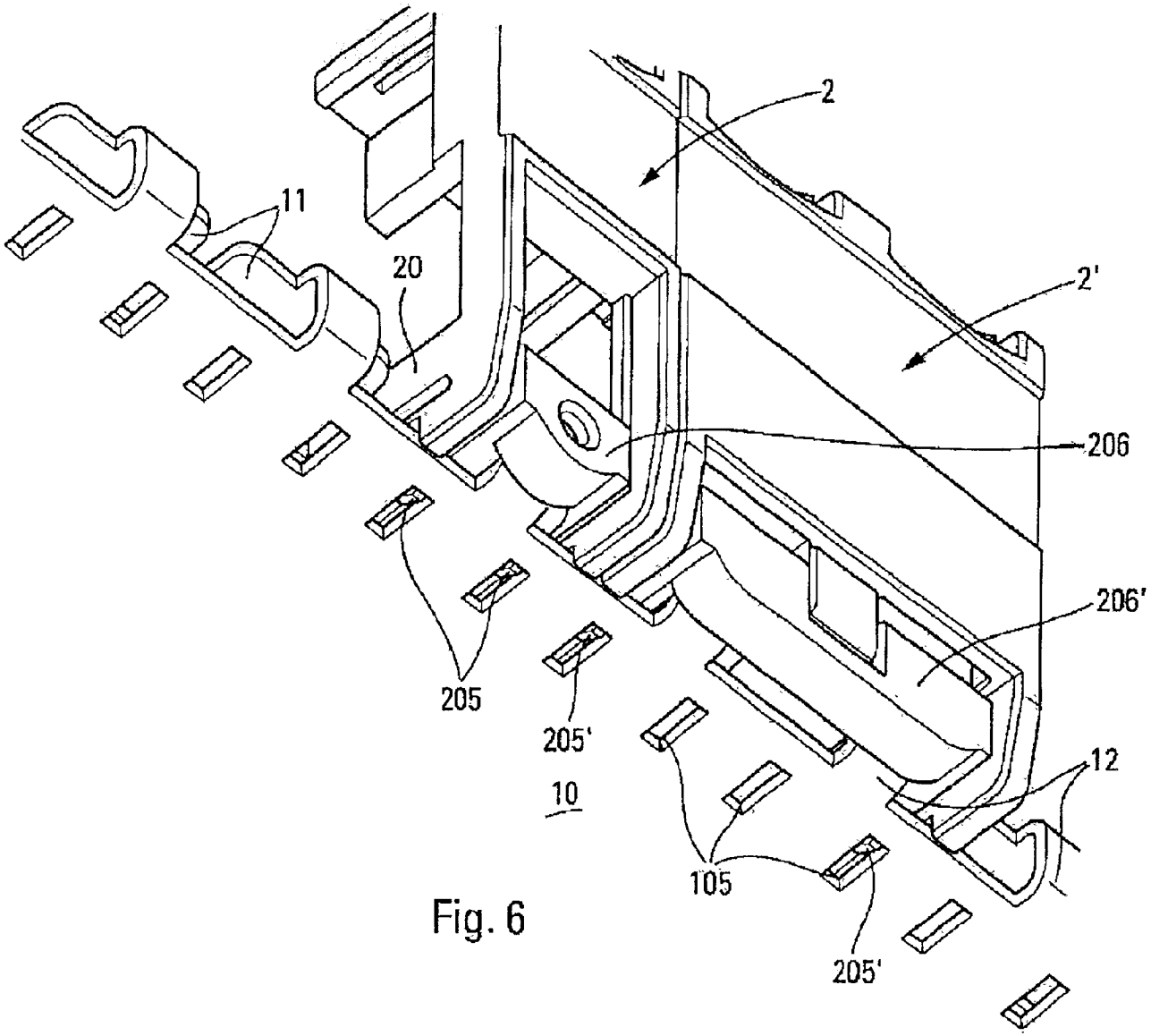
FIG. 6 is a perspective view from below showing the FIG. 5 connector supports mounted on the mounting shelf.

In FIG. 6, the snap-fastening studs 205 can be seen engaged in the holes 105. It can also be seen that the release members 206 and 206' come into abutment against the bridges 12 of the shelf 1.

Figure 7:
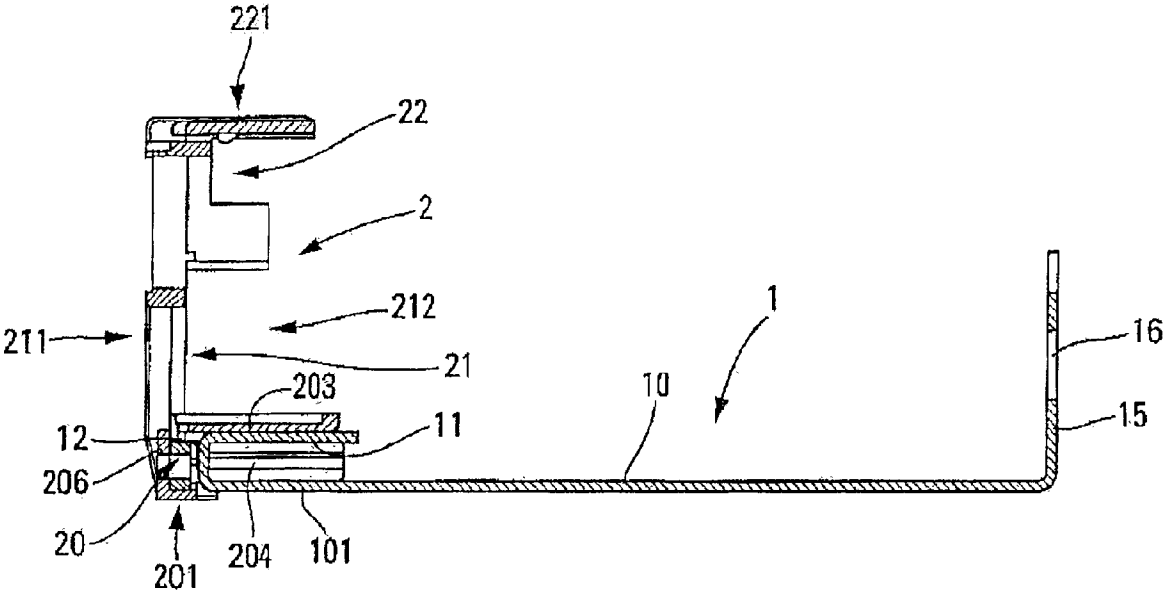
FIGS. 7 and 8 are vertical cross-section views on two perpendicular axes through the mounting assembly of FIG. 6.
Figure 8:
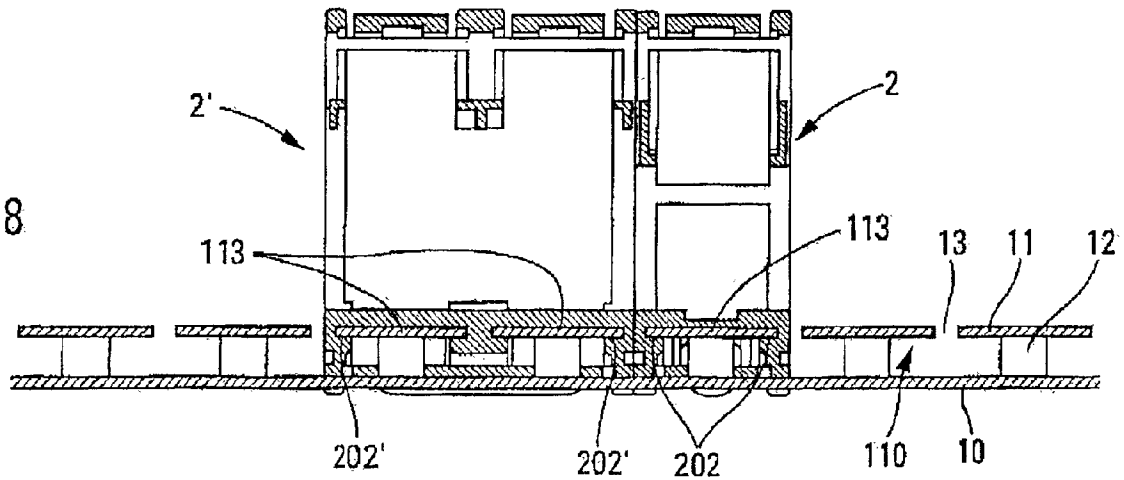

In FIGS. 7 and 8, it can be seen how the bases 20 of respective connector supports 2 and 2' co-operate with the shelf 1 for fixing purposes. In particular in FIG. 7, it can be seen that the side prongs 204 are engaged between the flap 11 and the front margin 101 of the base plate 10 with the release member 206 being situated immediately in front of the bridge 12 and with the slab 203 extending immediately above the flap 11. FIG. 8 shows clearly one tongue 213 engaged in the housing 202 of the support 2 and two tongues 213 engaged in the fixing housing 202' of the support 2'.

With such a mounting assembly of the invention, it is possible to fit connector supports from the front side of the mounting shelf, which shelf co-operates with the supports only via their bottom ends. Nevertheless, it is possible to devise other embodiments in which the connector supports co-operate with the shelf via their top ends. The spirit of the invention lies in the fact that the connectors are engaged with the shelf via one end which can be a top end or a bottom end, so that the supports extend vertically upwards or downwards relative to the shelf 1. As a result, the shelf does not interfere with the operations of mounting or withdrawing connectors on the connector supports and installing or removing connector supports on the shelf.

What is claimed is:

1. A connector-mounting assembly disposed in a distribution frame having at least one support rail for mounting said assembly thereon, comprising:

a longitudinal mounting shelf horizontally mounted to the distribution frame and provided with fastening means for fastening to said at least one rail, and with catch means placed along the length of the shelf; and at least one connector support operably mounted on the shelf to receive an electrical or optical connector and having a front face, a rear face, a bottom end, and a top end, said support being provided with fixing means co-operating with the catch means of the shelf to fix the support to the shelf, and with reception means adapted to receive the electrical or optical connector that is accessible from the front face, wherein the catch means extend in repeating manner substantially along a single line, and the fixing means of the support are situated at one end of the support so that the support projects vertically from the shelf when the shelf is fastened to a vertical support rail.

2. A mounting assembly according to claim 1, in which the fixing means of the support are situated at the bottom end of the support so that the support projects upwards from the shelf.

3. A mounting assembly according to claim 2, in which the reception means of the support are situated above the fixing means.

4. A mounting assembly according to claim 3, in which the support includes mounting means for holding an accessory, said mounting means being situated at the end opposite from the end where the fixing means are situated and being spaced apart from the fixing means by the reception means.

5. A mounting assembly according to claim 4, in which the accessory mounting means are situated at the free top end of the support going away from the catch means of the shelf.

6. A mounting assembly according to claim 1, in which the fixing means engage the catch means during displacement in horizontal translation when the shelf is mounted on vertical rails.

7. A mounting assembly according to claim 6, in which the fixing means form guide elements for movement in translation and snap-fastening shapes, and the catch means form guide appendices on which the guide means of the support are suitable for being engaged by sliding, and retaining shapes co-operating with the snap-fastening shapes of the support.

8. A mounting assembly according to claim 6, in which the fixing means comprise snap-fastening means co-operating with the catch means of the shelf at the end of displacement in translation.

9. A mounting assembly according to claim 8, in which the snap-fastening means include release means suitable for being actuated from the front face of the support.

10. A mounting assembly according to claim 9, in which the release means receive a fixing nut for receiving a connector accessory.

11. A mounting assembly according to claim 9, in which the snap-fastening means are situated level with a fixing base that integrates the fixing means.

12. A mounting assembly according to claim 1, in which the shelf has cable-guide means situated behind the catch means, the guide means comprising cable guides for slidably receiving cables.

13. A mounting assembly according to claim 12, in which the cable-guide means co-operate with locking members suitable for locking cables in their respective housings.

14. A mounting assembly according to claim 1, in which the mounting shelf has a front side and a rear side, the front face of the connector support being situated on the front side of the shelf and the rear face of the support facing towards the rear side of the shelf, the fixing means of the connector support co-operating with the catch means of the shelf in such a manner that the connector support can be withdrawn from the shelf by taking hold of the support via its front face from in front of the shelf and by moving the support away from the rear side of the shelf.

15. A connector-mounting assembly disposed in a distribution frame having at least one support rail for mounting said assembly thereon, comprising:

a longitudinal mounting shelf horizontally mounted to the distribution frame and provided with a fastener that fastens to the at least one rail, and with a plurality of catches placed along the length of the shelf; and at least one connector support operably mounted on the shelf to receive an electrical or optical connector and having a front face, a rear face, a bottom end, and a top end, said support being provided with a fixing device co-operating with the catches of the shelf that fixes the support to the shelf, and with a receptor that receives the electrical or optical connector that is accessible from the front face, wherein the catches extend in repeating manner substantially along a single line, and the fixing device of the support is situated at one end of the support so that the support projects vertically from the shelf when the shelf is fastened to a vertical support rail.

16. The mounting assembly according to claim 15, in which the fixing device of the support is situated at the bottom end of the support so that the support projects upwards from the shelf.

17. The mounting assembly according to claim 16, in which the receptor of the support is situated above the fixing device.

18. The mounting assembly according to claim 17, in which the support includes a mount that holds the accessory, the mount situated at the end opposite from the end where the fixing device is situated and spaced apart from the fixing device by the receptor.

19. The mounting assembly according to claim 18, in which the accessory mount is situated at the free top end of the support going away from the catches of the shelf.

20. The mounting assembly according to claim 15, in which the fixing device engages the catches during displacement in horizontal translation when the shelf is mounted on vertical rails.

21. The mounting assembly according to claim 20, in which the fixing device forms guide elements permitting movement in translation and snap-fastening shapes, and the catches form guide appendices on which the guide elements of the support are configured to be engaged by sliding, and retaining shapes co-operating with the snap-fastening shapes of the support.

22. The mounting assembly according to claim 20, in which the fixing device comprises a snap-fastener co-operating with the catches of the shelf at the end of displacement in translation.

23. The mounting assembly according to claim 22, in which the snap-fastener includes a release configured to be actuated from the front face of the support.

24. The mounting assembly according to claim 23, in which the release receives a fixing nut that receives a connector accessory.

25. The mounting assembly according to claim 23, in which the snap-fastener is level with a fixing base that integrates the fixing device.

26. The mounting assembly according to claim 15, in which the shelf has cable-guides behind the catches that slidably receive cables.

27. The mounting assembly according to claim 26, in which the cable-guides co-operate with locking members to lock cables in their respective housings.

28. The mounting assembly according to claim 15, in which the mounting shelf has a front side and a rear side, the front face of the connector support being situated on the front side of the shelf and the rear face of the support facing towards the rear side of the shelf, the fixing device of the connector support co-operating with the catches of the shelf in such a manner that the connector support can be withdrawn from the shelf by taking hold of the support via its front face from in front of the shelf and by moving the support away from the rear side of the shelf.

29. The mounting assembly of claim 15, wherein the mounting shelf comprises a horizontal base plate with a front side having repeated slots, and a rear side having repeated cable-receiving guides; and wherein the horizontal base plate includes repeated holes aligned near the front side, and wherein the connector support has a protrusion so that the connector support snap-couples with the horizontal base plate via one of the holes and the protrusion.

30. The mounting assembly of claim 29, wherein the front side of the horizontal base plate comprises a flap extending towards the rear side, the flap is spaced apart from the major surface portion of the base plate; and wherein the slots are formed in the flap and extend parallel to each other towards the rear side of the horizontal base plate, and the slots are opened towards or at the front side.

31. The mounting assembly of claim 30, wherein each slot has a narrow portion and wide portion, the wide portion disposed nearest or at the front side of the horizontal base plate and the narrow portion extending from the wide portion towards the rear side of the horizontal base plate.

* * * * *